US009753412B2

(12) United States Patent
Bayer et al.

(10) Patent No.: US 9,753,412 B2
(45) Date of Patent: Sep. 5, 2017

(54) ROLLER HAVING ELASTIC LAYERS FOR TRANSFERRING A PRINT IMAGE

(71) Applicant: Oce Printing Systems GmbH & Co. KG, Poing (DE)

(72) Inventors: Andreas Bayer, Poing (DE); Georg Landmesser, Haar (DE); Bernhard Hochwind, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/079,775

(22) Filed: Mar. 24, 2016

(65) Prior Publication Data

US 2016/0282768 A1 Sep. 29, 2016

(30) Foreign Application Priority Data

Mar. 25, 2015 (DE) ..... 10 2015 104 519

(51) Int. Cl.
*G03G 15/16* (2006.01)
*G03G 15/08* (2006.01)

(52) U.S. Cl.
CPC ..... *G03G 15/1605* (2013.01); *G03G 15/0808* (2013.01); *G03G 15/162* (2013.01); *G03G 15/1685* (2013.01)

(58) Field of Classification Search
CPC ..... G03G 15/1605; G03G 15/0808; G03G 15/1685; G03G 2215/00957; G03G 15/2053; G03G 15/206; G03G 2215/2048
See application file for complete search history.

(56) References Cited

U.S. PATENT DOCUMENTS 6,393,226 B1 * 5/2002 Charlebois ..... G03G 15/162 399/12
7,400,853 B2 * 7/2008 Furukawa ..... G03G 15/1685 399/313

FOREIGN PATENT DOCUMENTS

| | | |
|---|---|---|
| EP | 1195653 A2 | 4/2002 |
| EP | 1195655 A2 | 4/2002 |
| EP | 1804140 A1 | 7/2007 |
| WO | 2007077053 A1 | 7/2007 |

* cited by examiner

*Primary Examiner* — David M Gray
*Assistant Examiner* — Laura Roth
(74) *Attorney, Agent, or Firm* — Schiff Hardin LLP

(57) ABSTRACT

A roller for transferring a print image or a toner layer onto another element in a printer or copier is provided. The roller can include a base body, a first elastic layer applied onto the base body and a second elastic layer applied onto the first elastic layer, wherein the ratio of the moduli of elasticity of the elastic layers and/or the ratio of the thicknesses of the elastic layers are matched to one another so that the average surface velocity difference between the roller and the other element is reduced and/or minimized.

13 Claims, 4 Drawing Sheets

ROLLER HAVING ELASTIC LAYERS FOR TRANSFERRING A PRINT IMAGE

CROSS REFERENCE TO RELATED APPLICATIONS

This patent application claims priority to German Patent Application No. 102015104519.2, filed Mar. 25, 2015, which is incorporated herein by reference in its entirety.

BACKGROUND

The disclosure concerns a roller for transferring a print image or a toner layer onto another element in a printer or copier, wherein the roller has a base body and a first elastic layer applied onto the base body.

In printers or copiers, print images and toner layers are often transferred from one roller to another roller. The transfer of the print image onto the actual printing substrate also often takes place with the aid of rollers.

Given the transfer of the toner layer or of the print image between two rollers it is typical that one of the two rollers has an inelastic surface and the other roller is coated with an elastomer. The transfer of the print image onto the printing substrate also normally takes place with an elastomer-coated transfer roller past which the printing substrate web is directed. A hard, inelastic roller is in particular arranged in turn on the side of the printing substrate web that is opposite the elastomer-coated transfer roller. Due to the elastomer coating, a pressure profile develops within the contact zone upon transfer of the print image or of the toner layer. Due to the elasticity of the elastic layer, this pressure profile may be made uniform. A compensating effect with regard to mechanical tolerances and deformations thereby also takes place. A better print quality is thus achieved.

Upon pressing together the roller with the elastic layer and a hard roller without an elastic layer, the elastic layer is deformed. This deformation includes a radial component and a tangential component, wherein the desired adaptation to tolerances and deformations takes place via the radial component. The tangential component depends on the elastic properties of the roller coatings. The deformation may thereby lead to an enlarged or reduced contact zone between the rollers. The greater the force with which the two rollers are pressed together, the stronger the tangential deformations. Due to the tangential deformations of the contact zone between the two rollers, the surface velocity of the coated roller increases relative to the hard roller in the region of the contact. A relative velocity between the two rollers—which is unwanted in a printing process—is hereby created that leads to a negative effect on the print quality. This local variation of the surface velocity is generally designated as a conveying behavior.

What is particularly problematic with the conveying behavior is that this is not necessarily equally pronounced over the entire contact zone, but rather may be of different magnitude at different locations depending on the distance from the edge of the roller. This has the consequence that a countermeasure purely via variation of the drive velocities of the rollers could never entirely compensate the conveying behavior for all locations, and thus negative effects on the print quality due to the conveying behavior still take place at least at some locations.

Moreover, the conveying behavior is also different as viewed in the tangential direction of the contact zone, such that a corresponding countermeasure is not possible.

To minimize the conveying behavior, printing blankets are known from offset printing, which printing blankets are comprised of multiple layers of elastomers and rigid fabric. The application of such printing blankets for transfer printing rollers is not possible since a seamless roller coating is required.

From the document WO 2007/077053 A 1, a roller coating is known with the aid of which a defined compressibility of the material should be achieved via introduction of voids. A reinforcement hereby takes place via a grid. It is hereby problematic that a homogeneous electric field between the rollers is necessary for transfer printing, which would be prevented by such a grid.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
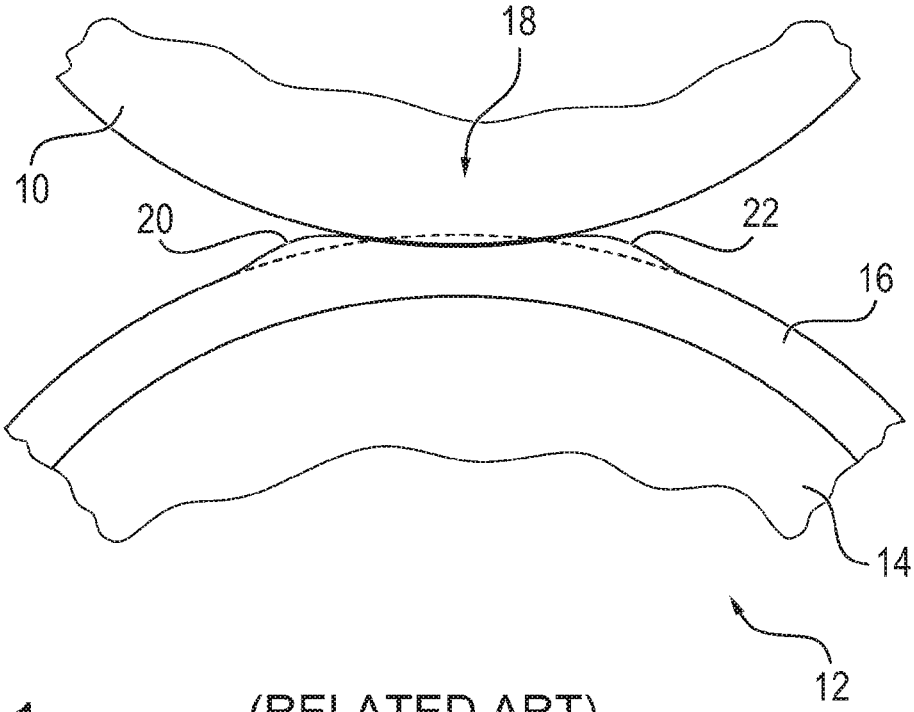
FIG. 1 (RELATED ART)
FIG. 1 illustrates a schematic section presentation of two transfer printing rollers in a printer or copier.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

It is an object of the disclosure to describe a roller for transferring a print image or a toner layer onto another element in a printer or copier, where the roller exhibits a minimal conveying behavior.

According to exemplary embodiments of the present disclosure, the modulus of elasticity of the first elastic layer and the modulus of elasticity of the second elastic layer, and/or the thickness of the first elastic layer and the thickness of the second elastic layer, are matched to one another. For example, the modulus of elasticity of the first elastic layer (104) and the modulus of elasticity of the second elastic layer (106) and/or the thickness of the first elastic layer (104) and the thickness of the second elastic layer (106) are matched to one another such that the average surface velocity difference between the roller (100) and the other element is minimized.

In an exemplary embodiment, the modulus of elasticity of the first elastic layer and the modulus of elasticity of the second elastic layer, and/or the thickness of the first elastic layer and the thickness of the second elastic layer, are matched to one another such that the average surface velocity difference within a series of different roller contact pressure forces is less than if the roller were to have only one layer with the modulus of elasticity of the first layer or of the second layer and the same total thickness.

In an exemplary embodiment, the average surface velocity difference is a measure of the conveying behavior, such that the minimization of the average surface velocity difference leads to a minimization of the conveying behavior, which in turn means an optimization of the print quality.

In an exemplary embodiment, via the at least two-layer design, the conveying behavior may thus be markedly reduced in comparison with the single-layer homogeneous design.

In an exemplary embodiment, the ratio of the moduli of elasticity and of the thicknesses of the elastic layers that is necessary for the minimization of the average surface velocity difference can be determined using finite element method (FEM) calculations. For this, the lateral displacement shift between the respective point on the roller and the respective opposite point of the other element is determined for a plurality of points along the contact line between the roller and the other element onto which the print image is transferred. When rolling along the contact lines is free of relative velocity, a displacement of zero would result.

In an exemplary embodiment, the curve that results as a consequence of these displacement values can be approximated by a straight line using distances squared. Alternatively, other approximation methods may also be used. In an exemplary embodiment, the slope of this straight line obtained in such a manner is a measure of the average surface velocity difference. In particular the ratio of the moduli of elasticity and the thicknesses of the elastic layers for which the slope is minimal are thus determined to minimize the average surface velocity difference. Alternatively, other methods for determining the average surface velocity difference may also be used.

In an exemplary embodiment, the determination of the ratio of the moduli of elasticity and the thicknesses of the elastic layers that are necessary to minimize the average surface velocity difference are performed individually for every application instance, in particular for every diameter of the base body of the roller and the contact pressure forces. In exemplary embodiments, different optimal ratios of the moduli of elasticity and/or of the thicknesses of the elastic layers may result depending on the diameter of the base body and depending on the contact pressure forces range.

In an exemplary embodiment of the present disclosure, the roller includes a base body, a first elastic layer applied onto the base body and a second elastic layer applied onto the first elastic layer, wherein the ratio of the modulus of elasticity of the first layer to the modulus of elasticity of the second layer is between 0.15 and 0.45.

In exemplary embodiments, tests and calculations, for example, FEM calculations, have yielded that the use of rollers with two elastic layers whose moduli of elasticity are in a ratio between 0.15 and 0.45 exhibit a particularly small conveying behavior which is markedly less than would result due to the thickness and the moduli of elasticity given only a single-layer design.

A particularly small conveying behavior—and therefore a particularly high print quality—is thus achieved by avoiding relative velocities between the roller and the element onto which the print image or the toner layer is transferred.

In an exemplary embodiment, the ratio of the modulus of elasticity of the first layer to the modulus of elasticity of the second layer is the quotient of the modulus of elasticity of the first elastic layer divided by the modulus of elasticity of the second elastic layer. Accordingly, what is understood by the ratio (repeatedly occurring in the following) of the thickness of the first elastic layer to the thickness of the second elastic layer is the quotient of the thickness of the first elastic layer and the thickness of the second elastic layer.

In an exemplary embodiment, the base body of the roller is formed from a rigid, inelastic material, for example metal. The base body can be, for example, cylindrical in shape. In an exemplary embodiment, the first layer is applied over the entire outer circumference of the base body. The first layer can be formed so as to be seamless. In an exemplary embodiment, the second elastic layer is accordingly applied in particular over the entire outer circumference of the first elastic layer, and can be likewise formed so as to be seamless. Alternatively, the layers may also respectively exhibit a seam.

In an exemplary embodiment, the ratio of the thickness of the first elastic layer to the thickness of the second elastic layer is between 1.0 and 5.0.

In an exemplary embodiment, the ratio of the thickness of the first elastic layer to the thickness of the second elastic layer is between 1.0 and 1.5, and the ratio of the modulus of elasticity of the first elastic layer to the modulus of elasticity of the second elastic layer is between 0.15 and 0.3.

In an exemplary embodiment, the ratio of the thickness of the first elastic layer to the thickness of the second elastic layer is between 1.5 and 2.5, and the ratio of the modulus of elasticity of the first elastic layer to the modulus of elasticity of the second elastic layer is between 0.25 and 0.4.

In an exemplary embodiment, the ratio of the thickness of the first elastic layer to the thickness of the second elastic layer is between 2.3 and 5.0, and the ratio of the modulus of elasticity of the first elastic layer to the modulus of elasticity of the second elastic layer is between 0.35 and 0.45.

In an exemplary embodiment, the ratio of the thickness of the first elastic layer to the thickness of the second elastic layer is greater than 2.5, and the ratio of the modulus of elasticity of the first elastic layer to the modulus of elasticity of the second elastic layer is greater than 0.35.

In exemplary embodiments, FEM calculations and tests have shown that, for the aforementioned thickness ratios given the corresponding associated ratios of the moduli of elasticity, a particularly small conveying behavior results, such that a particularly high-grade transfer printing takes place given the use of such rollers.

In an exemplary embodiment, the sum of the thickness of the first elastic layer and the second elastic layer is between 9 mm and 11 mm. In an exemplary embodiment, the sum of the thickness of the first elastic layer and the second elastic layer is between 10 mm and 10.5 mm. With this thickness of the elastic layer, a small conveying behavior is achieved given a nevertheless good deformation capability for compensation of mechanical tolerances.

In an exemplary embodiment, the first elastic layer has a thickness between 8 and 9 mm and a modulus of elasticity between 2.5 and 3.0 MPa. The second elastic layer has a thickness between 1.5 mm and 2.5 mm, as well as a modulus of elasticity between 7 MPa and 8 MPa. Given the use of the corresponding thicknesses and moduli of elasticity of the elastic layers, a particularly small conveying behavior is achieved. In an exemplary embodiment, the first elastic layer has a thickness of 8.5 mm given a modulus of elasticity of 2.7 MPa, and the second elastic layer has a thickness of 2 mm given a modulus of elasticity of 7.5 MPa.

In exemplary embodiments, silicone, polyurethane, ethylene propylene terpolymer or nitrile rubber may be used as materials for the layers, for example. These materials have the advantages that they have the aforementioned elastic properties and may be simply applied atop one another. The exemplary embodiments are not limited to these materials.

In an exemplary embodiment, the first and second elastic layer may be formed as one piece. In this case, effectively only one elastic layer is provided whose moduli of elasticity is not constant over its entire thickness, but rather has a first moduli of elasticity in a first partial region (which corresponds to the aforementioned first layer) and a second moduli of elasticity in a second partial region (which corresponds to the aforementioned second layer). In this case, the first partial region is arranged on the base body and the second partial region is arranged on the first partial region.

In an exemplary embodiment, three or more elastic layers may also be applied and matched to a minimal conveying behavior.

In exemplary embodiments, the roller described in the preceding can be used in printers or copiers for transfer printing onto another roller, or onto a printing substrate web directed over another roller. The respective other roller is in particular of rigid design, meaning that it has no elastic surface. For example, this other roller is manufactured from metal.

In an exemplary embodiment, the roller in particular has a total diameter of between 170 and 190 mm. In an exemplary embodiment, the total diameter of the roller is 180 mm. In exemplary embodiments, the base body of the roller has a diameter of between 160 and 180 mm, approximately 170 mm, or another diameter as would be understood by one of ordinary skill in the relevant arts.

In exemplary embodiments, the diameter of the hard roller against which the roller coated according to the disclosure presses is, for example, approximately half as large as the diameter of the coated roller. Relative to the aforementioned example of the dimensions of the coated roller, the hard roller has, for example, a diameter of between 80 and 100 mm. In an exemplary embodiment, the hard roller has a diameter of 90 mm, but is not limited thereto.

In exemplary embodiments, one or both of the coated roller and the hard roller may have a smaller or larger diameter. In particular, the aforementioned diameters may be scaled by a predetermined factor.

FIG. 1 illustrates a schematic depiction of a section of two conventional rollers 10, 12 that can be used for the transfer of a print image or of a toner layer in printers or copiers. The roller 12 hereby has a hard, not significantly elastic base body 14 onto which an elastic layer 16 is applied. In contrast to this, the counter roller 10 has no elastic layer and has a hard, inelastic surface. In particular, the surface of the counter roller 10 is made from metal.

Upon transfer of the print image or of the toner layer, the counter roller 10 is pressed with a predetermined force or a predetermined displacement against the roller 12. The elastic layer 16 is deformed in a contact region 18, wherein on the one hand a radial deformation occurs via which tolerances are compensated and a broad contact zone is achieved for transferring the print image, and on the other hand tangential deformations occur. These tangential deformations have the effect that the elastic layer deflects upward at the edge regions 20, 22 of the contact region 18.

The tangential component of the deformation leads to a relative velocity of the surface of the elastic layer 16 relative to the surface of the counter roller 10, via which the quality of the print image or of the toner layer is negatively affected. This relative movement is designated as a conveying behavior and is indicated in FIG. 3 (which depicts an enlarged section of FIG. 1) via the arrows within the elastic layer 16, of which one is designated with the reference character P1 as an example.

Figure 3:
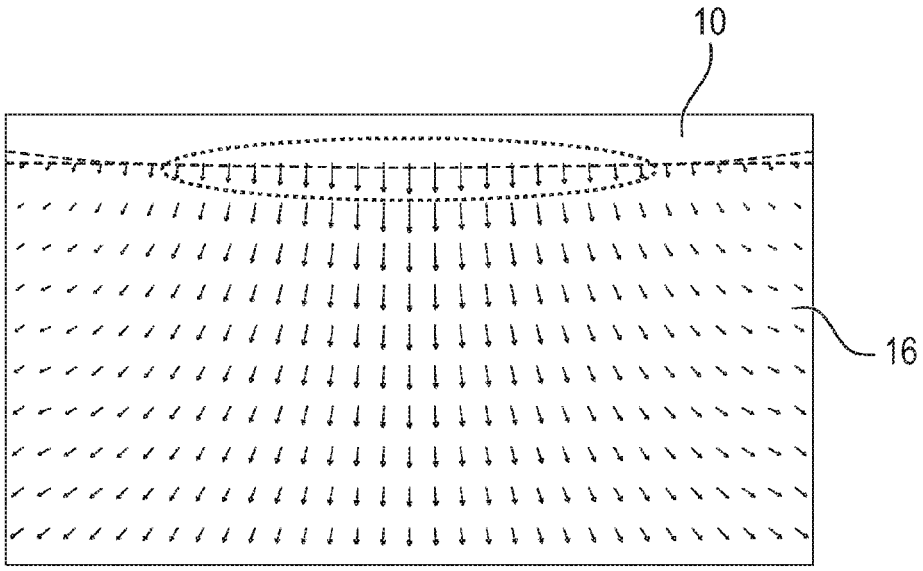
FIG. 3 (RELATED ART)
FIG. 3 illustrates a schematic depiction of the deformation of a roller with an elastic coating.

FIG. 3 illustrates a schematic depiction of a deformation determined using, for example, one or more FEM calculations, and the occurring displacements given contact between the counter roller 10 and the elastic layer 16 of the other roller 12. The contact region 18 is hereby indicated via the dotted ellipse. It may hereby be learned from FIG. 3 that the arrows are in particular facing outward and away in the edge region of the contact region, whereby the conveying behavior is created.

Figure 2:
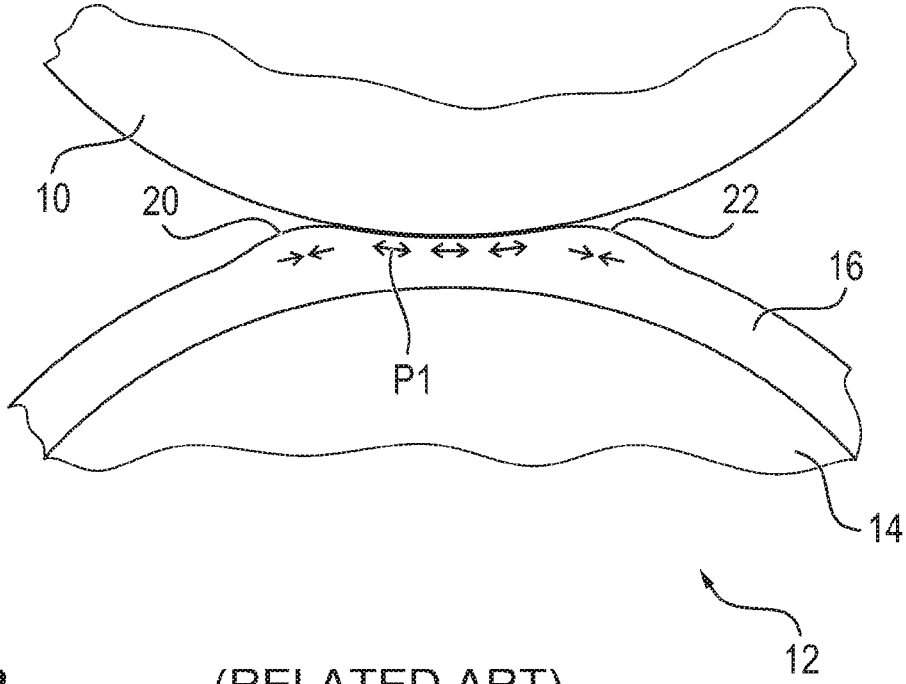
FIG. 2 (RELATED ART)
FIG. 2 illustrates an enlarged depiction of a section of the rollers according to FIG. 1.
Figure 4:
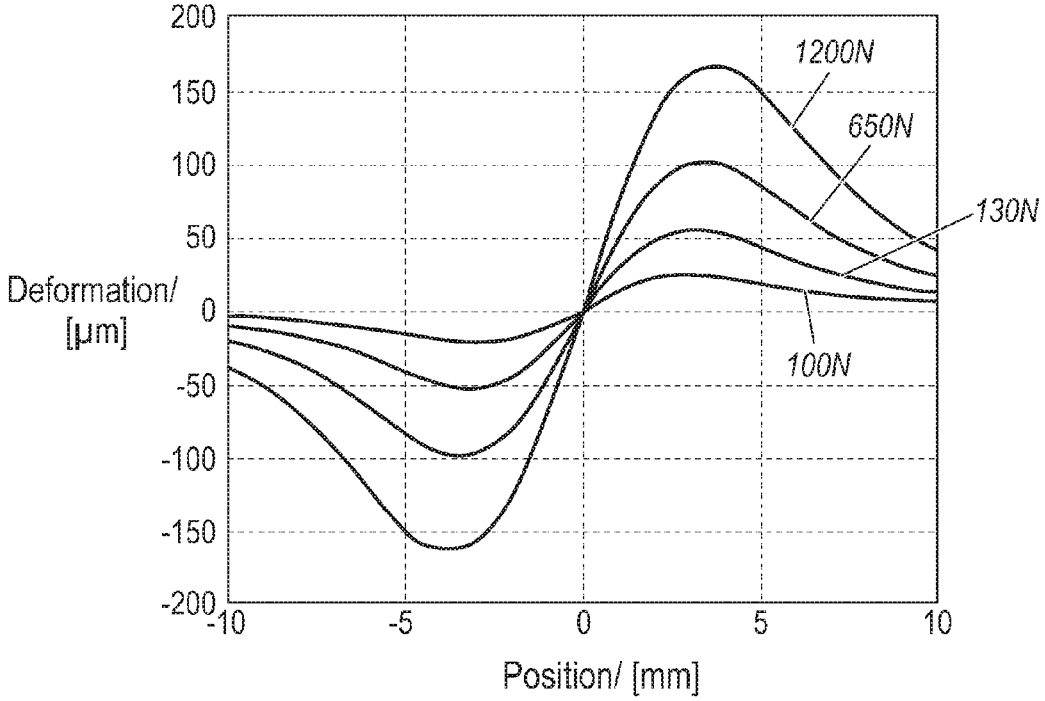
FIG. 4 (RELATED ART)
FIG. 4 illustrates a diagram of the conveying behavior of a roller according to FIG. 1.

FIG. 4 shows a diagram that illustrates the deformations occurring at the roller 12 according to FIGS. 1 and 2 given different contact pressure forces between the rollers 10, 12. The greater the deformation, and thus the conveying behavior, the greater the contact pressure force. Moreover, the deformation initially increases roughly proportionally with increasing distance from the center line of the contact area, before the slope flattens and finally decreases again. The conveying behavior is thus non-uniform over the contact area, which makes it impossible to compensate for this conveying behavior by means of control engineering.

Figure 5:
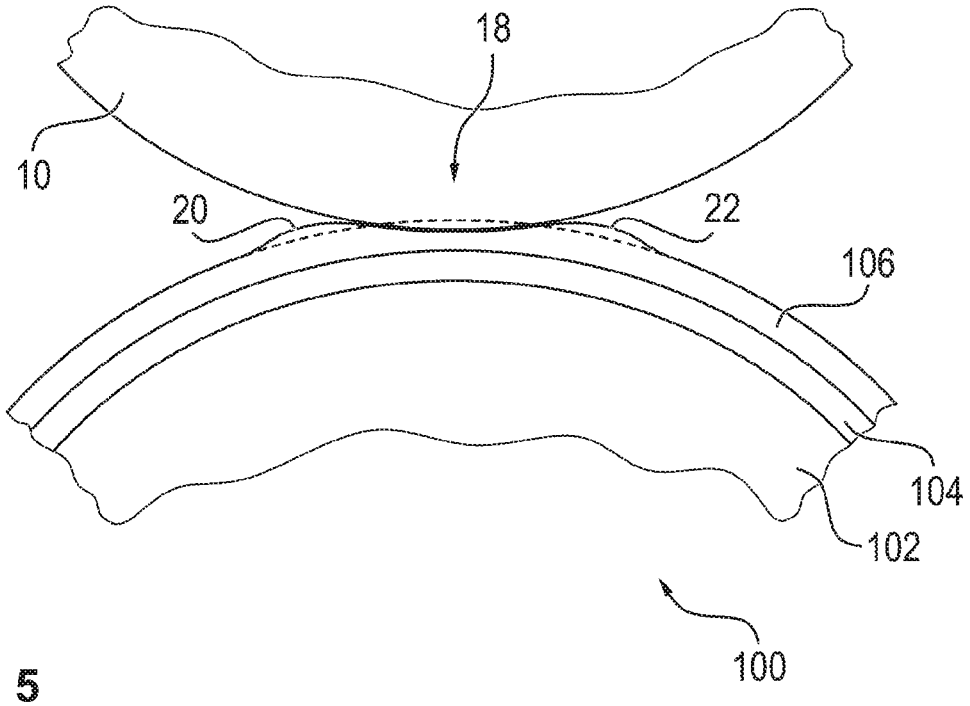
FIG. 5 illustrates a section presentation of a roller and a counter roller according to exemplary embodiments of the present disclosure.

FIG. 5 illustrates a schematic depiction of a section of a roller 100 according to an exemplary embodiment, and the roller's 100 interaction with counter roller 10. In an exemplary embodiment, the roller 100 has a base body 102 that is of inelastic (i.e., hard) design. In an exemplary embodiment, the base body 102 is made of metal and of cylindrical design. In an exemplary embodiment, a first elastic layer 104 is applied on the base body 102. A second elastic layer 106 can be applied on to the first elastic layer 104. In an exemplary embodiment, the two elastic layers 104, 106 have different moduli of elasticity.

In an exemplary embodiment, only one elastic layer may be formed such that the single elastic layer has a first modulus of elasticity in a partial region corresponding to the first elastic layer 104 and a second modulus of elasticity in a second partial region corresponding to the second elastic layer 106. In this example, the second partial region adjoins the first partial region.

Figure 6:
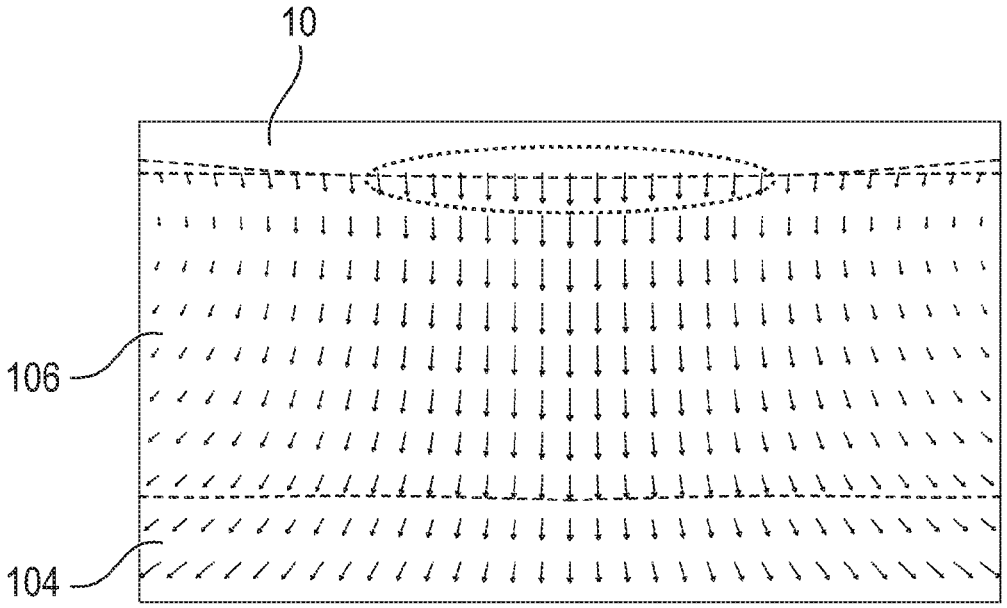
FIG. 6 illustrates a schematic depiction of an example deformation of an elastic layer of the roller shown in FIG. 5.

FIG. 6 illustrates a deformation image according to an exemplary embodiment. The deformation image illustrates how the elastic layers 104, 106 of the roller 100 deform via the contact with the counter roller 10. In an exemplary embodiment, the deformation image is determined using one or more FEM calculations. The contact region 18 is hereby again indicated via the dotted ellipse.

In comparing the active forces and the deformations of the elastic layer 106 of the roller 100 that result with those of the elastic layer 16 of the roller 10 according to FIG. 3, it can be seen that the arrows that indicate the displacements in the contact region are directed nearly vertically downward (thus into the elastic layer 106) and have a reduced or no tangential component that leads to a conveying behavior. In contrast to this, the arrows in FIG. 3 have an outwardly directed tangential component that is responsible for the conveying behavior.

Using the two-layer design of the elastic layer of the roller 100 according to the exemplary embodiments, it is thus achieved that the conveying behavior is minimized and thus the quality of the transfer of the print image or of the toner layer is improved.

Figure 7:
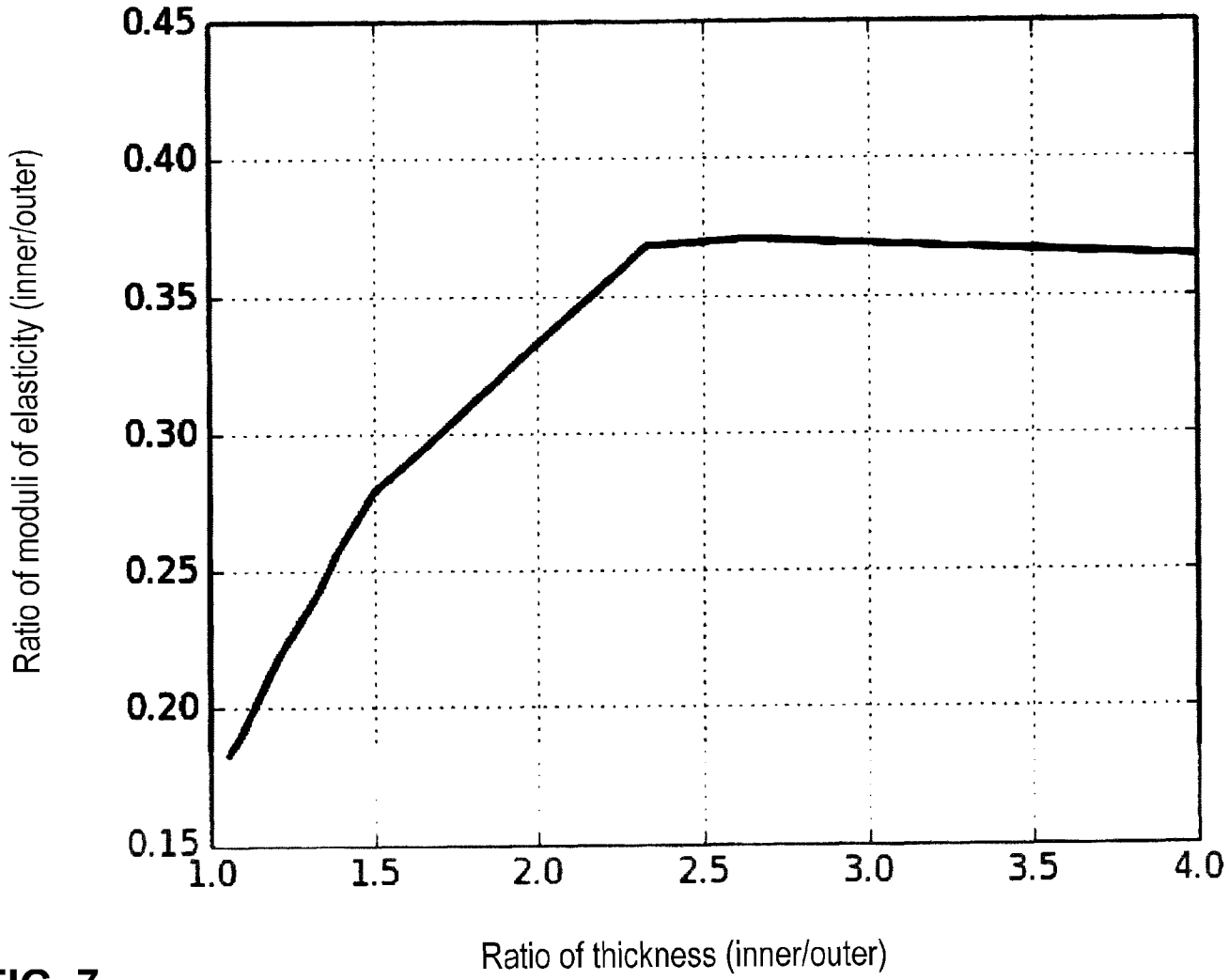
FIG. 7 illustrates a diagram of ratios of the thickness of the elastic layer and the ratios of the moduli of elasticity of the elastic layers according to exemplary embodiments of the present disclosure.

FIG. 7 illustrates a diagram of the ratio of the modulus of elasticity of the first layer 104 to the modulus of elasticity of the second layer 106 over the ratio of the thickness of the first elastic layer to the thickness of the second elastic layer according to exemplary embodiments. In an exemplary embodiment, the respective ratio of the two ratios is shown that results in a minimal conveying behavior.

For example, given a ratio of the thicknesses of 1.5, the minimal conveying behavior results given a ratio of the moduli of elasticity of approximately 0.28. With a ratio of the thicknesses of >2.3, the minimal conveying behavior results in a ratio of the moduli of elasticity of approximately 0.37.

In an exemplary embodiment, the ratios shown in FIG. 7 for a minimal conveying behavior are determined using one or more FEM calculations. In an exemplary embodiment, a total diameter (including coatings) of 180 mm can be used for the roller 100, and a diameter of 90 mm can be used for the counter roller 10. In an exemplary embodiment, the counter roller 10 is hard (similar to the base body 12 of the roller 100), and the total thickness of the two layers 104, 106 together is 10 mm and the moduli of elasticity of the second layer 106 is 5.5 MPa, but are not limited thereto.

In an exemplary embodiment, the assessment was respectively taken using three contact pressure forces 685 N/m, 1027 N/m and 1370 N/m, where the evaluation respectively took place in a 2D model. A 2D FEM calculation of the cross section through the two rollers was implemented for each of these contact pressure forces. The lateral displacement between the respective point on the roller 100 and the respective opposite point of the counter roller 10 was determined for a plurality of points along the contact line. Given a rolling along the contact line that is free of relative velocity, a displacement of zero would thus result.

The actual curve that results as a consequence of these displacement values is approximated by a straight line by means of distances squared. The slope of this straight line obtained in such a manner is a measure of the average surface velocity difference, thus the conveying behavior. The ratios shown in FIG. 7 result via the corresponding evaluation. In an exemplary embodiment, the results shown in FIG. 7 can be treated as ideal or optimal ratios.

In an exemplary embodiment, the first elastic layer 104 has a thickness of 8.5 mm and a modulus of elasticity of 2.7 MPa. The second elastic layer 106 has a thickness of 2 mm given a modulus of elasticity of 7.5 MPa. In this case, the ratio of the thickness of the first elastic layer 104 to the thickness of the second elastic layer 106 is 4.25, and the ratio of the modulus of elasticity of the first elastic layer 104 to the modulus of elasticity of the second elastic layer 106 is 0.36.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

REFERENCE LIST

10 counter roller
12 roller
14 base body
16 elastic layer
18 contact region
20, 22 edge region adjoining the contact region
100 roller
102 base body
104 first elastic layer
106 second elastic layer
P1 arrow

What is claimed is:

1. A roller for transferring a print image or a toner layer between the roller and another element in a printer or copier, the roller comprising:

a base body;

a first elastic layer applied onto the base body; and a second elastic layer applied onto the first elastic layer, wherein at least one of: (1) a modulus of elasticity of the first elastic layer and a modulus of elasticity of the second elastic layer are set in an elasticity ratio, and (2) a thickness of the first elastic layer and a thickness of the second elastic layer are set in a thickness ratio, such that an average surface velocity difference between the roller and the other element is minimized, and wherein the elasticity ratio of the modulus of elasticity of the first elastic layer to the modulus of elasticity of the second elastic layer is between 0.15 and 0.45.

2. The roller according to claim 1, wherein the thickness ratio of the thickness of the first elastic layer to the thickness of the second elastic layer is between 1.0 and 5.0.

3. The roller according to claim 1, wherein the thickness ratio of the thickness of the first elastic layer to the thickness of the second elastic layer is between 1.0 and 1.5, and wherein the elasticity ratio of the modulus of elasticity of the first elastic layer to the modulus of elasticity of the second elastic layer is between 0.15 and 0.3.

4. The roller according to claim 1, wherein the thickness ratio of the thickness of the first elastic layer to the thickness of the second elastic layer is between 1.5 and 2.3, and wherein the elasticity ratio of the modulus of elasticity of the first elastic layer to the modulus of elasticity of the second elastic layer is between 0.25 and 0.4.

5. The roller according to claim 1, wherein the thickness ratio of the thickness of the first elastic layer to the thickness of the second elastic layer is between 2.3 and 5.0, and wherein the elasticity ratio of the modulus of elasticity of the first elastic layer to the modulus of elasticity of the second elastic layer is between 0.35 and 0.45.

6. The roller according to claim 1, wherein the thickness ratio of the thickness of the first elastic layer to the thickness of the second elastic layer is greater than 2.3.

7. The roller according to claim 1, wherein a sum of the thickness of the first elastic layer and the thickness of the second elastic layer is between 9 mm and 11 mm.

8. The roller according to claim 1, wherein a sum of the thickness of the first elastic layer and the thickness of the second elastic layer is between 10 mm and 10.5 mm.

9. The roller according to claim 1, wherein at least one of:

the first elastic layer has a thickness between 8 mm and 9 mm and a modulus of elasticity between 2.5 MPa and 3.0 MPa, and the second elastic layer has a thickness between 1.5 mm and 2.5 mm and a modulus of elasticity between 7 MPa and 8 MPa.

10. The roller according to claim 1, wherein at least one of:

the first elastic layer has a thickness of 8.5 mm and a modulus of elasticity of 2.7 MPa, and the second elastic layer has a thickness of 2 mm and a modulus of elasticity of 7.5 MPa.

11. The roller according to claim 1, wherein the first and second elastic layer are integrally formed.

12. A roller for transferring a print image or a toner layer between the roller and another element in a printer or copier, the roller comprising:

a base body;

a first elastic layer disposed on the base body, the first elastic layer having a first modulus of elasticity and a first thickness; and a second elastic layer disposed on the first elastic layer and configured to contact the other element, the second elastic layer having a second modulus of elasticity greater than the first modulus of elasticity and a second thickness less than the first thickness, wherein an elasticity ratio of the first modulus of elasticity and the second modulus of elasticity is between 0.15 and 0.45, and wherein the elasticity ratio of the first modulus of elasticity and the second modulus of elasticity and a thickness ratio of the first thickness and the second thickness are selected such that an average surface velocity difference between the roller and the other element is minimized.

13. A roller for transferring a print image or a toner layer between the roller and another element in a printer or copier, the roller comprising:

a base body; and an elastic layer formed on the base body and operable to contact the other element, the elastic layer including:

a first elastic layer portion having a first modulus of elasticity and a first thickness; and a second elastic layer portion being formed on the first elastic layer portion and being operable to contact the other element, the second elastic layer portion having a second modulus of elasticity greater than the first modulus of elasticity and a second thickness less than the first thickness, wherein an elasticity ratio of the first modulus of elasticity and the second modulus of elasticity is between 0.15 and 0.45, and wherein the elasticity ratio of the first modulus of elasticity and the second modulus of elasticity and a thickness ratio of the first thickness and the second thickness are selected such that an average surface velocity difference between the roller and the other element is minimized.

* * * * *